US005227143A

United States Patent [19]

Stewart, Jr. et al.

[11] Patent Number: 5,227,143

[45] Date of Patent: Jul. 13, 1993

[54] PROCESS FOR THE REMOVAL OF SALTS FROM ALUMINUM DROSS

[75] Inventors: Donald L. Stewart, Jr., Greensburg; Jan H. L. vanLinden, Allison Park, both of Pa.

[73] Assignee: Aluminum Company of America, Pittsburgh, Pa.

[21] Appl. No.: 766,035

[22] Filed: Sep. 26, 1991

[51] Int. Cl.[5] ..... C01D 3/16; C22B 26/10

[52] U.S. Cl. ..... 423/197; 423/131; 423/122; 423/155; 423/158; 423/163; 423/184; 423/499.1; 423/497

[58] Field of Search ..... 423/111, 131, 155, 158, 423/122, 497, 179, 184, 499.1, 497; 75/416, 672

[56] References Cited

U.S. PATENT DOCUMENTS

| | | | |
|---|---|---|---|
| 3,642,454 | 2/1972 | Nylander | 23/297 |
| 3,852,044 | 12/1974 | Neitzel et al. | 23/298 |
| 3,853,535 | 12/1974 | Mogyorosi et al. | 75/1 |
| 3,930,974 | 1/1976 | Kane et al. | 204/105 |
| 4,073,644 | 2/1978 | Papafingos et al. | 75/68 |
| 4,090,916 | 5/1978 | Papafingos et al. | 159/9 |
| 4,275,847 | 6/1981 | Bahr et al. | 241/20 |
| 4,379,718 | 4/1983 | Grantham et al. | 75/24 |
| 4,569,723 | 2/1986 | Lyon et al. | 159/48.1 |
| 4,723,962 | 2/1988 | Mehta | 23/302 R |
| 4,732,606 | 3/1988 | Kobele et al. | 75/24 |
| 4,752,328 | 6/1988 | Peterson | 75/24 |
| 5,102,453 | 4/1992 | Yerushalmi | 75/416 |

FOREIGN PATENT DOCUMENTS

| | | |
|---|---|---|
| 275814 | 12/1986 | European Pat. Off. . |
| 7106792 | 11/1971 | Netherlands . |
| 1431898 | 4/1976 | United Kingdom . |
| 1549979 | 8/1979 | United Kingdom . |

*Primary Examiner*—Theodore Morris
*Assistant Examiner*—Edward Squillante
*Attorney, Agent, or Firm*—Wood, Herron & Evans

[57] ABSTRACT

A process is disclosed for treating salt-containing aluminum dross to remove potassium and sodium chloride salts therefrom. The process generally comprises treating the dross in a first treating step with a leaching solution having a pH maintained in the range of about 6–7 to remove a portion of the salt content thereof; filtering the residual solids from the first leaching solution; and treating the filtered solids in a second treating step with a second leaching solution having a pH maintained above about 8, and preferably above about 9. The pH of the first leaching solution is maintained in the desired range by the addition of hydrochloric acid, and the pH of the second leaching solution is maintained in the desired range by the addition of potassium and/or sodium hydroxide.

20 Claims, 1 Drawing Sheet

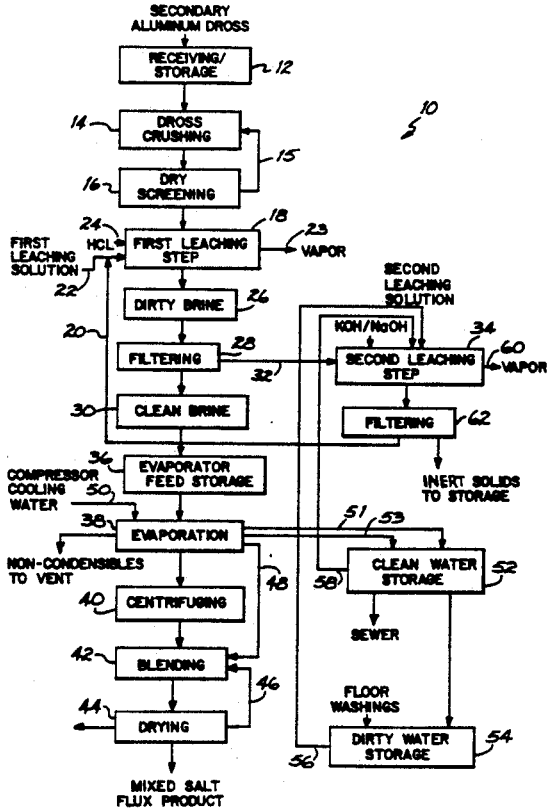

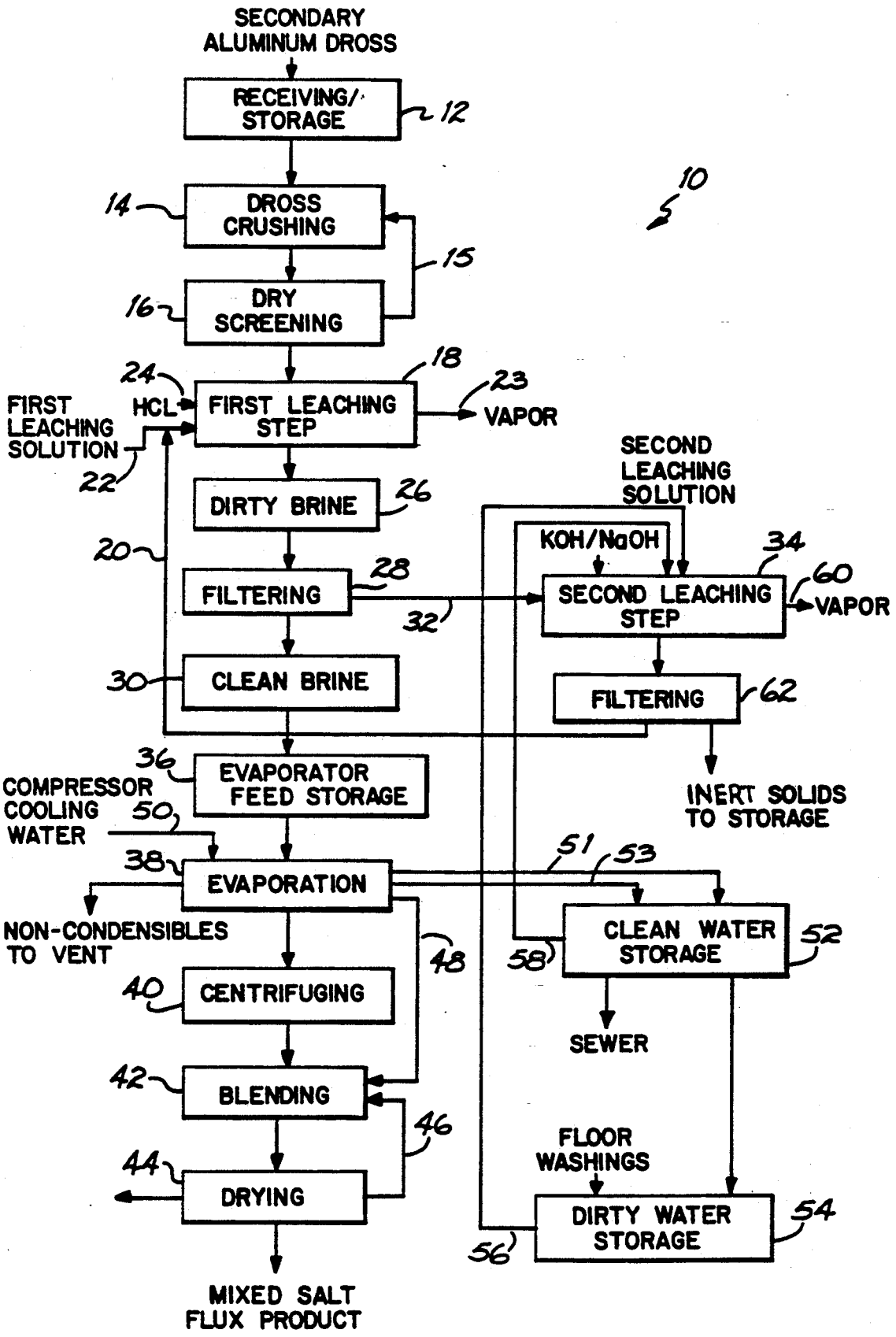
SECONDARY ALUMINUM DROSS
RECEIVING/ STORAGE
12
10
14
DROSS CRUSHING
15
16
DRY SCREENING
18
24
23
FIRST LEACHING SOLUTION
HCL
FIRST LEACHING STEP
VAPOR
22
SECOND LEACHING SOLUTION
DIRTY BRINE
26
KOH/NaOH
34
20
28
60
FILTERING
SECOND LEACHING STEP
VAPOR
32
30
CLEAN BRINE
FILTERING
62
36
EVAPORATOR FEED STORAGE
INERT SOLIDS TO STORAGE
COMPRESSOR COOLING WATER
50
51
53
38
EVAPORATION
NON-CONDENSIBLES TO VENT
CLEAN WATER STORAGE
52
48
58
40
CENTRIFUGING
SEWER
42
BLENDING
46
FLOOR WASHINGS
44
DRYING
DIRTY WATER STORAGE
54
56
MIXED SALT FLUX PRODUCT

PROCESS FOR THE REMOVAL OF SALTS FROM ALUMINUM DROSS

FIELD OF THE INVENTION

The present invention relates to a process for the removal of salt from aluminum dross, and more particularly it relates to a sequential, two-step leaching process for salt-containing aluminum dross.

BACKGROUND OF THE INVENTION

During the smelting of aluminum scrap, such as used beverage containers and the like, large quantities of salt flux, normally containing sodium and/or potassium chlorides, are added to the smelter furnaces. This flux accumulates on top of the molten bath and forms a dross which typically contains aluminum values in the form of metallic aluminum, as well as aluminum oxides and metal salts.

There are various known procedures for processing secondary aluminum dross or salt cake. One such process involves initially reducing the particle size of the dross, e.g., by impact and ball milling processing. Following particle size reduction, the dross is melted under a salt flux cover to dissolve the contaminants therein, mostly aluminum oxide, and recover the aluminum metal. Typically, rich dross (containing 30–70% aluminum) and low-grade dross (containing 5–30% aluminum) are melted in rotary furnaces using a sodium chloride-potassium chloride flux which may include 2–5% cryolite. As the flux becomes contaminated with aluminum oxide, it is removed as salt slag (by skimming or raking) and then solidified. Although this salt slag contains potentially valuable materials that could be recovered, it is generally the practice to dispose of the salt slag in a landfill. However, the soluble salts present in the slag represent a potential source of pollution to surface and ground water supplies. Accordingly, it is increasingly important, both for economic as well as environmental reasons, to eliminate landfill disposal of these salt slags.

Other previously employed procedures for processing secondary aluminum dross involve crushing the aluminum dross, separating the larger and smaller particles, and concurrently treating the larger and smaller particles in distinct leaching operations. In a specific prior process of this general type, magnesium chloride is added to the leaching solution, which is used to leach the larger particles, to maintain the pH of that solution in the range of about 7–8.5. This process is described in co-pending and commonly owned U.S. patent application Ser. No. 07/756,359, filed on Sep. 9, 1991, the specification of which is hereby incorporated herein by reference.

Although these known prior procedures are intended to remove the metal salts from the aluminum dross, they may not achieve maximum salt removal from the aluminum dross, and thus the residual solids may not be sufficiently inert for landfill disposal.

SUMMARY OF THE INVENTION

The method of the present invention serves to remove substantially all of the metal salt content from secondary aluminum dross by solubilizing the salt in a two-step, sequential leaching process. The leaching solutions containing the solubilized salts may be treated to recover the salts (primarily sodium and potassium chlorides) therefrom, and the residual solids, which are typically inert, can be used as raw materials in producing cement or refractory materials, or they can be safely disposed of in landfills since they are inert.

In a preferred embodiment, the process of the present invention includes subjecting the salt-containing aluminum dross to a multi-pass grinding operation to reduce the dross to a size suitable for subsequent treating steps, while at the end of each pass screening out the aluminum as the oversize fraction.. Thereafter, the ground dross is treated in a first treating step with a first leaching solution having a pH maintained in the range of about 6–7. The pH of this first leaching solution is preferably maintained in the desired range by the periodic or continuous addition of a sufficient quantity of hydrochloric acid, as necessary. During this first treating step, a substantial portion of the salt content of the ground dross is dissolved and removed from the dross, including species such as magnesium chloride ($MgCl_2$), which decompose to some extent at higher pH. The residual solids from the first leaching step are then filtered from the first leaching solution; the filtered leaching solution or brine is fed to an evaporation operation and the wet solids stream is fed to a second leaching step.

The residual wet solids from the filtering step, which contain additional salts, are treated in a second treating step with a second leaching solution which has a pH maintained above about 8, and preferably above about 9. The salt content in the residual solids from the first leaching step is substantially completely removed in this second leaching step. Reactive compounds such as aluminum nitride (AlN), aluminum carbide and residual aluminum are oxidized substantially completely. The pH of the second leaching solution is maintained above about 8, and preferably above about 9, by the addition of potassium hydroxide or sodium hydroxide, or mixtures thereof, on a periodic or continuous basis and in sufficient quantities to maintain the desired pH level.

The residual solids from the second leaching step are then filtered from the second leaching solution. The substantially clear, weak filtered brine may be recycled and combined with hydrochloric acid for use as the first leaching solution in the first leaching step. The residual solids from the second filtering step are substantially inert oxides or oxyhydrates which may be used as raw material in the production of cement or other refractory materials. Alternatively, these inert solids may be disposed of in a landfill without posing an environmental hazard.

In a preferred embodiment, the filtering steps in the process of the present invention are carried out in a suitable filter. The clean brine filtrate separated from the residual solids of the first leaching step is then subjected to evaporation-crystallization to recover the sodium and potassium chloride salts therefrom. Any suitable evaporator-crystallizer may be used for this purpose. A portion of the slurry in the evaporator-crystallizer is preferably purged to prevent the build-up of magnesium and calcium chloride salts in the slurry which, due to their relatively high solubility, would otherwise increase the boiling point of the slurry to such an extent as to require excessive evaporator shutdown.

The mixed salt flux product produced in the evaporator-crystallizer should have a content substantially the same as that of the fluxing salt used in the initial smelting operation from which the secondary aluminum dross was obtained. Accordingly, this mixed salt flux product is suitable for reuse at the smelting facility.

These and other features and advantages of the present invention will become apparent from the following detailed description taken in conjunction with the accompanying Figure.

BRIEF DESCRIPTION OF THE DRAWING

The Figure is a schematic flow diagram of a preferred embodiment of the process of the present invention.

DETAILED DESCRIPTION OF THE INVENTION

With reference to the Figure, a processing system for the removal of salts from aluminum dross or salt cake is generally designated by the reference numeral 10. The secondary aluminum dross to be processed is transported, e.g., by truck or rail, or otherwise conveyed to receiving and storage site 12. While the composition of this dross will vary depending upon the source of supply, it may typically contain about 5–50% aluminum, 15–50% salts, with the balance being oxides and nitrides. The metallic salt content includes sodium and potassium chlorides, as well as relatively small amounts of magnesium and calcium chlorides and/or cryolite.

The dross is transported by any suitable solids handling device to dross crushing location 14. A typical crushing operation involves crushing the dross with a roll crusher, followed by a screening process such as the process described in U.S. Pat. No. 4,126,673, the specification of which is hereby incorporated herein by reference, to reduce the size of the larger particles to produce a ground dross product in which the particles are preferably in the range of 0.01–0.03", or which do not exceed about 0.05". It will be apprecited that particle size reduction devices other than that discussed above may be used in the process of the present invention.

The ground dross from dry screening operation 16 is supplied to a suitable tank (not shown) and subjected to first leaching step 18. In this first leaching step, the ground dross is treated with a first leaching solution which preferably has a pH maintained in the range of about 6–7. The first leaching solution may be a stock aqueous solution containing sufficient hydrochloric acid so that the pH is in the range of about 6–7. Preferably, however, the first leaching solution is recycled filtered brine from the second leaching step, described in detail below. As shown, this brine is recycled via line 20. The first leaching solution, whether it is a stock solution or recycled brine, or a combination of both, is supplied via process line 22 to the suitable tank (not shown), which has been charged with the ground dross particles. During the first leaching operation, at least a portion of the soluble metal salts contained in the dross are solubilized and removed from the dross. This first leaching operation is normally conducted at atmospheric pressure using a minimum amount of leach solution to extract the maximum amount of salt because, as will be appreciated, the leaching solution added at this stage of the process must be subsequently removed by evaporation.

Using a suitable pH sensing device (not shown), the pH of the first leaching solution is continuously monitored during the first leaching step. Leaching at a pH of 6–7 allows dissolution and recovery of salts such as magnesium chloride, which partially decompose or react with water at higher pH. Hydrochloric acid is added via process line 24 to the first leaching step 18, as needed, to maintain the pH of the first leaching solution in the desired range of about 6–7. The addition of hydrochloric acid to the first leaching solution serves to stabilize and maintain the pH of the leach solution at the desired level during the leaching operation by suppressing the reactions that would otherwise tend to increase the pH of the brine; the pH stabilization thereby minimizes production of undesirable by-product gases.

The pH of the first leaching solution is preferably maintained between about 6 and 7 by the addition of hydrochloric acid. It is undesirable to add excess hydrochloric acid since that would drive the pH of the solution into the acidic region. Since the solubility of lead is near zero at pH greater than 7 and becomes much higher as the pH approaches 4, undesirable amounts of lead may be solubilized in the first leach solution if it is too acidic, thereby presenting problems in the disposal of that solution. On the other hand, as the pH of the brine increases from a neutral solution, the reaction rate of the aluminum nitride (AlN) present in the dross, which reacts with water to produce $NH_3$ and $Al_2O_3$, also increases. Since $NH_3$ is an undesirable reaction by-product, it is important to minimize the production thereof; this may be accomplished by suppressing the AlN reaction by lowering the pH of the brine to a point near or below neutral. Furthermore, at pH greater than 9, metallic aluminum reacts with water to produce aluminum hydroxide ($Al(OH)_3$), which is soluble, and tends to drive the pH level of the brine up even further, thereby increasing the AlN reaction.

The addition of hydrochloric acid to the first leaching solution serves the function of suppressing the reactions that drive up the pH of the leaching solution. The specific amount of hydrochloric acid necessary to add to the leach liquid is dependent upon the composition and reactivity of the dross processed in the first leaching step. The gaseous by-products which evolve during the first leaching step are vented via vapor discharge line 23.

The first leaching step preferably has a duration in the range of about 3–20 minutes, and more preferably in the range of about 5–10 minutes. During this operation, a substantial portion of the salts contained in the dross is solubilized and removed from the dross. Thereafter, the contents of the leaching tank are fed to a dirty brine storage location 26. In the illustrated embodiment, the contents of dirty brine storage location 26 are supplied to and processed in a filtering operation 28. In that operation, a clean brine filtrate, which is supplied to a clean brine storage tank 30, and a wet solids stream containing the residual solids from the first leaching step, are separated. The wet solids stream is supplied via process line 32 to a second leaching operation 34. The filtering operation 28 may be accomplished using any suitable filtering device.

Clean brine storage location 30 may include one or more storage tanks (not shown) of suitable size, each of which is preferably equipped with an agitator. As shown, clean brine from storage location 30 is supplied to an evaporator feed storage location 36. If desired, although not shown, a preheater can be interposed between the clean brine and evaporator feed storage locations 30 and 36, respectively. Preferably, evaporator feed storage location 36 is an evaporator feed tank equipped with an agitator. Any suitable evaporator-crystallizer can be used in the process of the present invention. Preferably, the feed to the evaporator is heated in one or more preheaters (not shown) which use the condensate from the evaporator heater as the heating means. The evaporator is designated generally by reference numeral 38 in the Figure.

Slurry discharge from the elutriation leg of the evaporator is supplied to a centrifuge 40 and the wet salt cake from the centrifuge is supplied to a blending station 42 wherein it may be combined with dried salt in a pug mill or equivalent mixer. The discharge from the mixer or blending station 42 is then sent to a drying station 44 which, if desired, may include a conventional rotary dryer with a gas-fired air heater. The mixed salt flux product from the dryer can be used as the salt flux in smelting operations of the type from which the original dross was obtained. Additionally, a portion of the discharge from the dryer may be recycled via line 46 to blending station 42 to serve as the dried salt source for blending station 42.

It will be appreciated that during the evaporation operation, the potassium and sodium chloride contents of the brine will be readily crystallized; however, magnesium chloride and other highly soluble salts which may be present in the brine will typically remain in solution. As such, continued operation of the evaporator will eventually result in the raising of the boiling point of the slurry, thereby eventually necessitating evaporator shut down. Stabilization of the boiling point of the slurry in the evaporator may be effectively achieved by the removal of a purge stream from the slurry in the evaporator via purge line 48. As shown, purge line 48 feeds the purge stream withdrawn from evaporator 38 to blending operation 42 where it is discharged onto the mixed salt contained therein such that all or substantially all of the dissolved salts are recovered.

The condensate from evaporator 38 serves as the second leaching solution and may be supplied to a clean water storage tank 52 via line 51, and thereafter supplied to second leaching step 34 via supply line 58.

The wet solids stream containing residual solids from the first leaching step is subjected to a second leaching step 34 and this wet solids stream is supplied thereto via process line 32. In this second leaching step, a second leaching solution is used to treat the filtered solids with a leaching solution having a pH maintained above about 8, and preferably maintained above about 9. The pH of the second leaching solution is continuously monitored with a suitable pH monitoring device (not shown) and the pH of the second leaching solution is controlled and maintained at the desired level by the addition of potassium hydroxide, sodium hydroxide, or mixtures thereof. It will be appreciated that various other compounds may be employed to maintain the desired pH in the second leaching step; however, potassium and sodium hydroxide are the preferred compounds. From a practical standpoint, the pH of the second leaching solution is preferably above about 9, but the higher the pH the quicker will be the deactivation of AlN and the quicker will be the reaction of the remaining metallic aluminum.

The duration of the second leaching step is dependent upon the fineness of the ground dross. For environmental reasons, however, it is desirable to completely or virtually completely deactivate the dross. The time required to accomplish this may be in the range of about 2–5 hours. The second leach solution deactivates the dross by converting the AlN and $Al_4C_3$ present in the dross to aluminum hydroxide and evolves ammonia, methane and other hydrocarbon gases. These gases are vented from the second leaching step via vapor discharge line 60. The residual solids from the second leaching step are subsequently filtered in a suitable filtering device, designated generally as 62. The solids, which are inert oxides or oxyhydrates of aluminum and other metals, may be conveyed to a storage location for subsequent use. These inert solids may be suitable for use as raw materials in the production of cement or other refractory materials. They may also be landfilled, if desired, since they pose no environmental hazards. The leaching solution, subsequent to filtration, is recycled via process line 20 and is used as at least a portion of the make-up fluid for the first leaching solution.

It will be apparent to those skilled in the art that various aspects of the present invention can be modified without departing from the spirit and scope of the invention, which is defined by the appended claims.

What is claimed is:

1. A process for treating salt-containing aluminum dross to remove chloride salts therefrom, comprising:

(a) treating the dross in a first treating step with a first leaching solution having a pH maintained in the range of about 6–7, whereby a substantial portion of the salt content of the dross is removed therefrom;

(b) filtering the residual solids from the first leaching solution;

(c) treating the filtered solids in a second treating step with a second leaching solution having a pH maintained above about 8, whereby additional salt is removed therefrom; and (d) filtering the residual solids from the second leaching solution.

2. The process of claim 1 further comprising grinding the dross prior to said first treating step.

3. The process of claim 1 wherein the pH of the first leaching solution is maintained in the range of about 6–7 by the addition of hydrochloric acid.

4. The process of claim 1 wherein said first treating step has a duration in the range of about 3–20 minutes.

5. The process of claim 4 wherein said first treating step has a duration in the range of about 5–10 minutes.

6. The process of claim 1 wherein the pH of the second leaching solution is maintained above about 9.

7. The process of claim 1 wherein the pH of the second leaching solution is maintained above about 8 by the addition of a base selected from the group consisting of potassium hydroxide, sodium hydroxide, and mixtures thereof.

8. The process of claim 1 wherein said second treating step has a duration in the range of about 2–5 hours.

9. The process of claim 1 wherein salts are recovered from the first leaching solution subsequent to said first treating step.

10. The process of claim 1 wherein salts are recovered from the second leaching solution subsequent to said second treating step.

11. A process for treating salt-containing aluminum dross to remove chloride salts therefrom, comprising:

(a) grinding the dross;

(b) treating the ground dross in a first treating step with a first leaching solution having a pH maintained in the range of about 6–7 by the addition of hydrochloric acid, whereby a substantial portion of the salt content of the dross is removed therefrom;

(c) filtering the residual solids from the first leaching solution;

(d) treating the filtered solids in a second treating step with a second leaching solution having a pH maintained above about 8 by the addition of a base selected from the group comprising potassium hydroxide, sodium hydroxide, and mixtures thereof, whereby additional salt is removed therefrom; and (e) filtering the residual solids from the second leaching solution.

12. In a process for treating ground salt-containing aluminum dross to remove chloride salts therefrom, the improvement comprising:

(a) treating the ground dross in a first treating step with a first leaching solution having a pH maintained in the range of about 6–7, whereby a substantial portion of the salt content of the dross is removed therefrom;

(b) filtering the residual solids from the first leaching solution;

(c) treating the filtered solids in a second leaching step with a second leaching solution having a pH maintained above about 8, whereby additional salt is removed therefrom; and (d) filtering the residual solids from the second leaching solution.

13. The process of claim 12 wherein the pH of the first leaching solution is maintained in the range of about 6–7 by the addition of hydrochloric acid.

14. The process of claim 12 wherein said first treating step has a duration in the range of about 3–20 minutes.

15. The process of claim 14 wherein said first treating step has a duration in the range of about 5–10 minutes.

16. The process of claim 12 wherein the pH of the second leaching solution is maintained above about 9.

17. The process of claim 12 wherein the pH of the second leaching solution is maintained above about 8 by the addition of a base selected from the group comprising potassium hydroxide, sodium hydroxide, and mixtures thereof.

18. The process of claim 12 wherein said second treating step has a duration in the range of about 2–5 hours.

19. The process of claim 12 wherein salts are recovered from the first leaching solution subsequent to said first treating step.

20. The process of claim 12 wherein salts are recovered from the second leaching solution subsequent to said second treating step.

* * * * *